United States Patent [19]

Reitmeier et al.

[11] Patent Number: 5,014,896

[45] Date of Patent: May 14, 1991

[54] STAPLE GUN FOR ATTACHING LABELS

[75] Inventors: Jerry Reitmeier, Goshen; Wayne Marquardt, South Bend; Mark Smith, Granger, all of Ind.; David Nethers, Union, Mich.

[73] Assignee: Reit Distributing Corp., Goshen, Ind.

[21] Appl. No.: 417,600

[22] Filed: Oct. 5, 1989

[51] Int. Cl.[5] ..... B25C 5/06; B25C 7/00

[52] U.S. Cl. ..... 227/39; 227/40; 227/76; 227/47; 227/99; 227/150

[58] Field of Search ..... 227/18, 39, 76, 46, 227/155, 45, 47, 99, 150, 120, 136, 40

[56] References Cited

U.S. PATENT DOCUMENTS

| | | | |
|---|---|---|---|
| 2,160,552 | 5/1939 | Maiben | 227/76 X |
| 2,331,252 | 10/1943 | Van Tuyl | 227/76 X |
| 2,351,557 | 6/1944 | Swett et al. | 227/76 X |
| 2,912,697 | 11/1959 | Westbrook | 227/39 |
| 2,996,720 | 8/1961 | Mackechinie | 227/76 |
| 3,385,498 | 5/1968 | Downie | 227/18 |
| 3,476,302 | 11/1969 | Hurd | 227/46 |
| 4,014,488 | 3/1977 | Potucek et al. | 227/136 X |

*Primary Examiner*—Paul A. Bell

*Attorney, Agent, or Firm*—James D. Hall

[57] ABSTRACT

A pneumatic label stapling gun including a label feed attachment and a cutting device which rapidly feeds a label into alignment with the staple gun head and severs the label from the remainder of the label roll after stapling. A pair of pneumatic cylinders are included and are connected to a common spool valve. One pneumatic cylinder is connected to a label advance head which reciprocates within the attachment housing to rapidly advance label into position. The other cylinder is connected to a cutter device which severs the stapled label from the remainder of the roll. The labels have spaced notches which are engaged by a protrusion carried by a spring which engages the label on its upward movement to prevent the labels from shifting the advance head as the head is retracted to engage the next label.

6 Claims, 4 Drawing Sheets

179
84
82
24
85
82
32
90
80
76
78
92
34
88
33
35
94
28
86
73
72
96
105
102
100
103
99
101
107
111
98
27
18
20
30
26

30
18
8.
112
96
105
111
102
104
107
92
109
98
28
8.

186
22
18
107
98
72
186
190

STAPLE GUN FOR ATTACHING LABELS

BACKGROUND OF THE INVENTION

This invention relates to a staple gun and will have specific reference to a staple gun for attaching labels to wood products or the like.

It is becoming common place for lumber companies and mills to use labels bearing bar codes, commonly referred to as UPC lables, for inventory control and computer pricing. heretofore, such labels have been attached by a user carrying a roll of the UPC labels placing one against the board, stapling it to the board and then severing the stapled label from the remainder of the roll. This process is currently performed by hand is very time consuming which increases the price of lumber to the consumer.

SUMMARY OF THE INVENTION

This invention eliminates the above problems by providing a staple gun capable of carrying a roll of labels. The gun staples a single label to a product and severs the label from the remainder of the roll in rapid succession. A notched label can be attached to a product and the next label advanced into stapling position in rapid succession which lowers labor costs to the manufacturer. The staple gun includes a guide which directs the labels through a cutter and under the staple gun head. When the gun trigger is pulled a staple is air driven from the gun in common manner and into the label and the label is severed from the remainder of the roll. When the trigger is released a new label is automatically advanced into place. Labels are advanced by an air actuated cam arrangement which engages the label notches.

Accordingly, it is an object of this invention to provide for a novel label stapling gun.

Another object of this invention is to provide for a label stapling gun wherein labels may be stapled to a product and severed from the remainder of the label roll in rapid succession.

Another object is to provide for a label stapling gun which includes a cam to engage notches between each label to advance the labels through a cutter and beneath the staple gun head.

Other objects of this invention will become apparent upon a reading of the following description taken with the accompanying drawings.

DESCRIPTION OF THE PREFERRED EMBODIMENT

Figure 1:
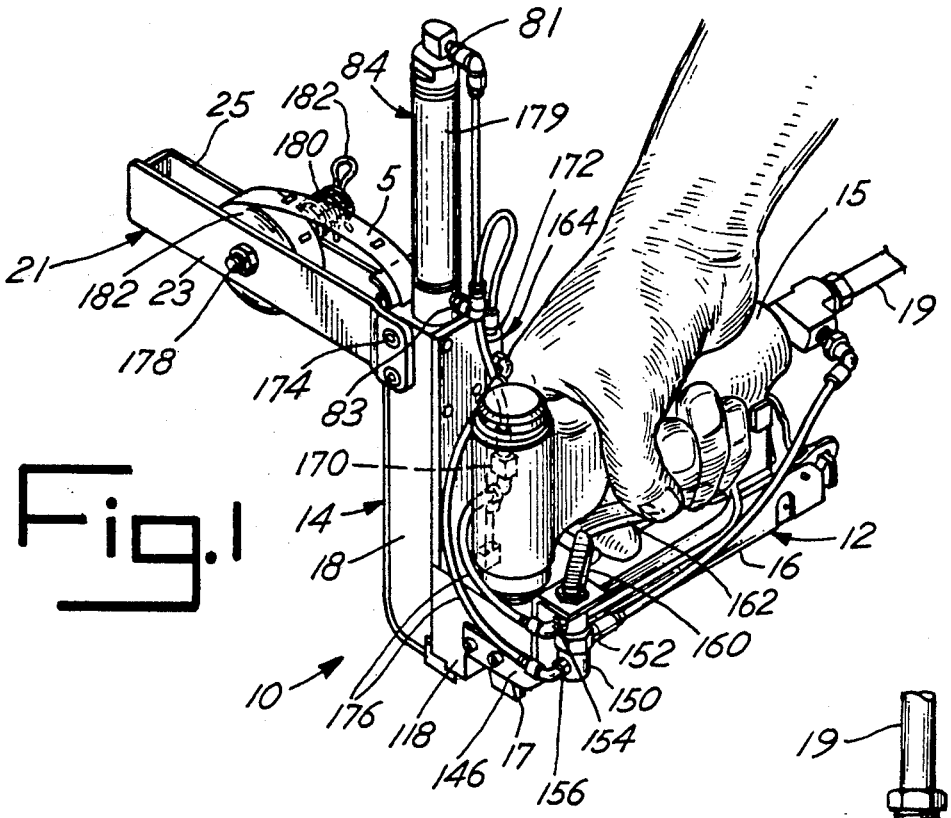
FIG. 1 is a perspective view of the invention having a roll of notched labels attached.

The preferred embodiment herein disclosed is not intended to be exhaustive or limit the application to the precise form disclosed. Rather it is intended to enable others skilled in the art to utilize its teachings.

Referring now to the drawings, label stapler 10 includes a common staple gun 12 having a label feeding attachment 14 connected thereto. Staple gun 12 as is common includes a handle 15 connected to a staple feed assembly 16. A pneumatically activated power unit (not shown) is included to advance staples (not shown) upon trigger actuation outwardly from head 17. An air line 19 (partially shown) is connected to staple gun 12 and is adapted for connection at its other end to an appropriate pressurized air source (not shown). The construction and operation of staple gun 12 is common in the industry and does not constitute a novel poriton of the invention.

Figure 6:
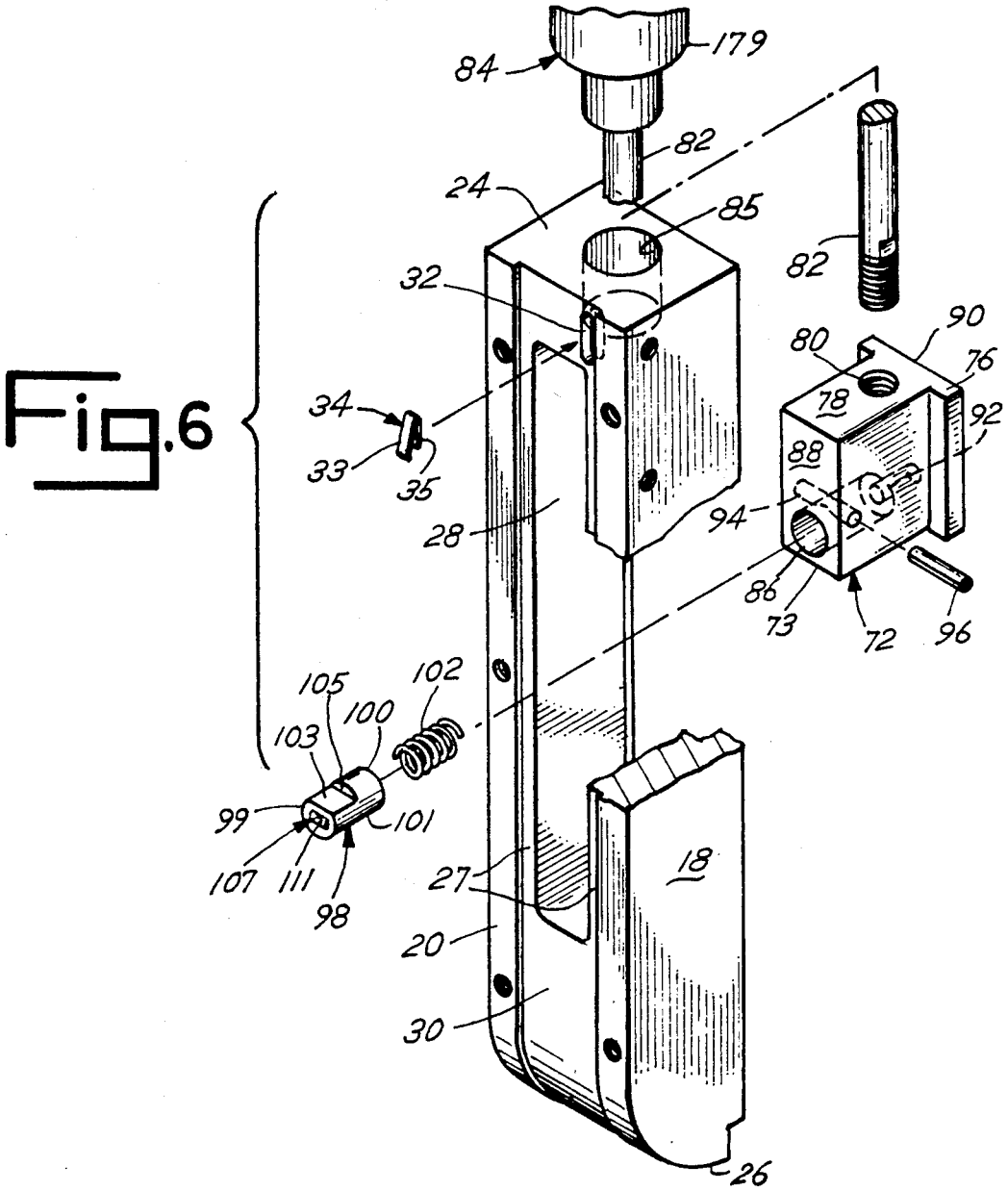
FIG. 6 is an exploded view of the housing and advance head of the invention.
Figure 9:
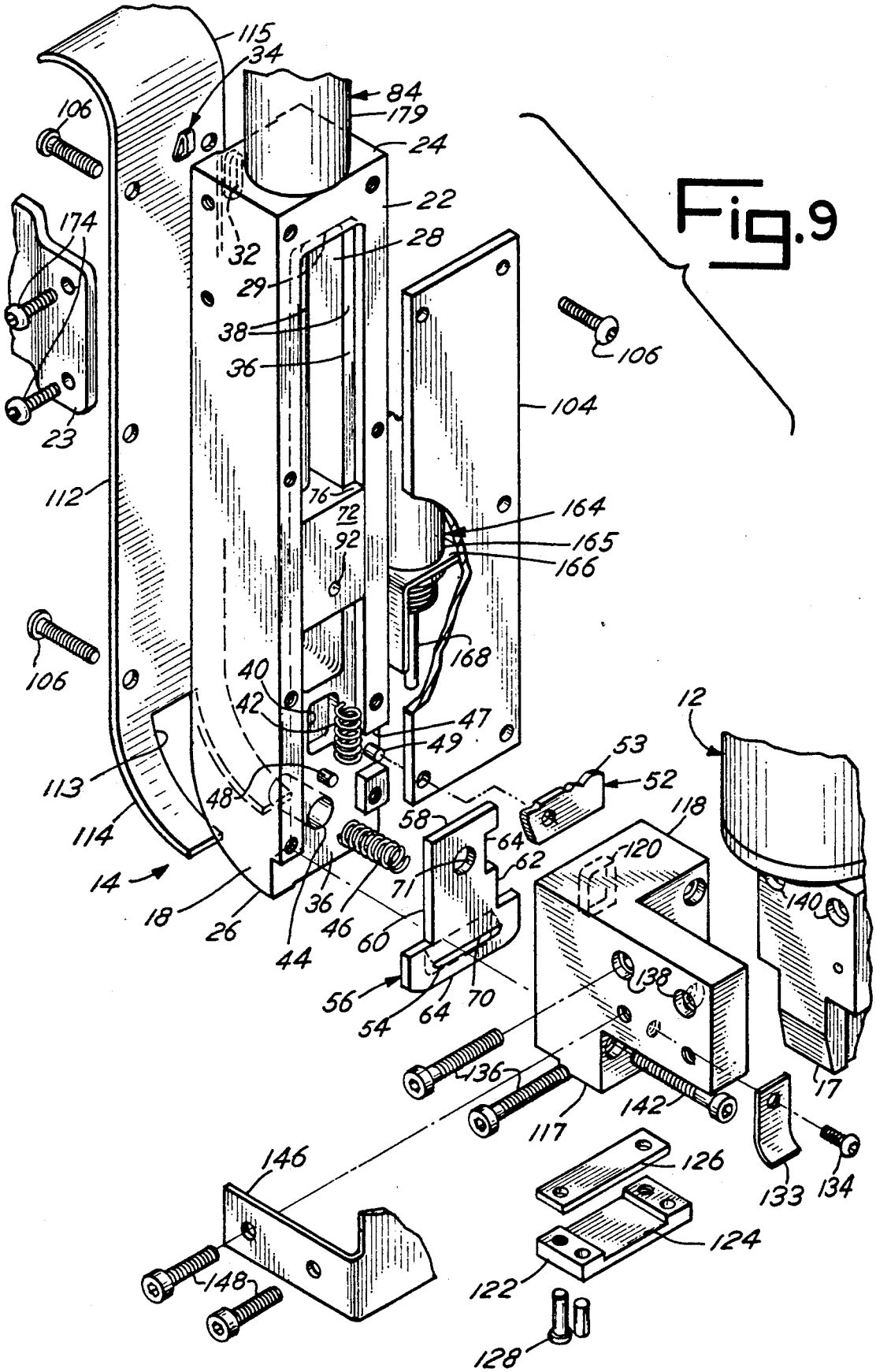
FIG. 9 is a fragmented exploded view of the label feeding attachment of this invention.

Label feeding attachment 14 as shown in the figures is attached to gun 12 by block 118 and screws 136. Label feeding attachement 14 includes a main housing 18 which has a label roll support 21 attached thereto and extending substantially perpendicular therefrom. Housing 18 is best illustrated in FIGS. 6 and 9 as having outer and inner walls 20, 22, distal end 24 and proximal end 26. As illustrated in the figures, proximal end 26 of housing 18 is rounded inwardly from outer wall 20 to inner wall 22. A longitudinal through channel 28 is formed in housing 18 and extends from outer wall 20 to inner wall 22. A shallow groove 30 is formed in outer wall 20 and extends the length of housing 18 and is wider than channel 28 as illustrated in FIG. 6 to define shoulders 27. Housing 18 further has a notch 32 adjacent distal end 24 for slidably accommodating a spring 34 therein.

A groove 36 is formed in inner wall 22 and extends from proximal end 26 and terminates adjacent channel upper wall 29. Groove 36 is wider than channel 28 to define shoulders 38. A generally retangular cavity 40 is formed in groove 36 to partially accommodate a helical spring 42 therein. Spring 42 is oriented along the longitudinal dimension of housing 18. A blind bore 44 transverse to housing 18 extends from wall 22 into the housing adjacent proximal end 26 and partially accommodates a helical spring 46 therein. Pins 48, 49 extend outwardly from inner wall 22 adjacent proximal end 26. A notch 47 is formed in inner wall 22 about guide pin 49 to accommodate a lever 52 therein with lever 52 being pivotal about pin 49.

A cutter 56 which includes upper wall 58, side walls 60 and 62 and a bottom end wall 64, is slidably carried by housing 18. Side wall 62 has a notch 64 to accommodate one end of lever 52. A slotted opening 54 is formed through cutter 56 and includes bevelled edges which define sharpened cutting edge 70. An opening 71 is formed through cutter 56 as illustrated to accommodate pin 48 which limits the distance that the cutter may be shifted .

Figure 7:
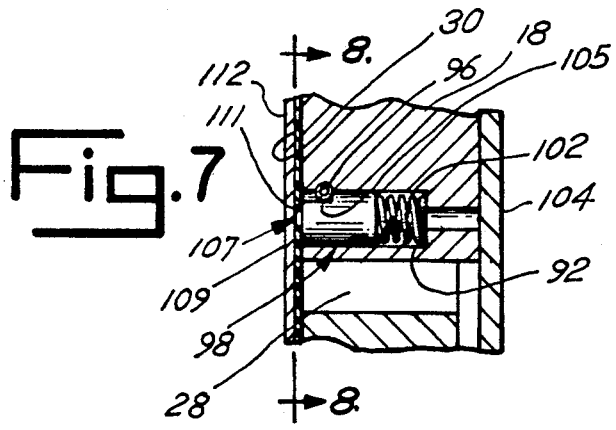
FIG. 7 is an exploded sectional view of circled area 7 in FIG. 3.
Figure 8:
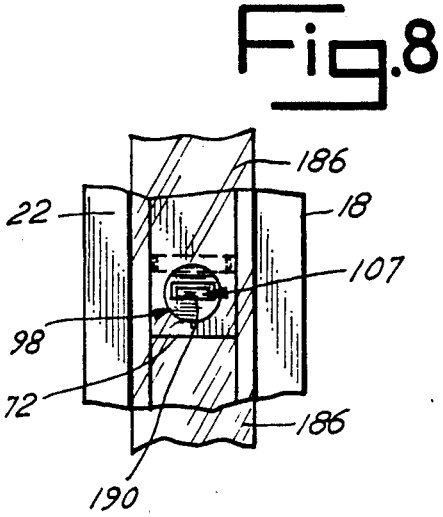
FIG. 8 is an elevational view taken along line 8—8 of FIG. 7.

A label advance head 72 is slidably carried within notch 28 of housing 18 and includes a generally T-shaped body having base 73 and flanges 76. A threaded blind bore 80 extends from upper wall 78 of base 73 into head 72 for accommodating the threaded end of the rod 82 of a power member 84. A throughbore 86 formed through base 73 and extends from outer wall 88 to inner wall 90. As illustrated best in FIG. 6, through bore 86 is stepped and defines an internal shoulder 92. A transverse through bore 94 in communication with bore 86 is formed in head 72 for accommodating a common roll pin 96. Generally cylindrical label engaging insert 98 is slidably accommodated within bore 86 and includes ends 99, 100 and a side wall 101. Side wall 101 includes a flattened portion 103 which defines a shoulder 105. End 99 includes a small protrustion 107 which has a rounded top wall 111 and a bottom wall 109 which extends substantially perpendicular to end 99. A helical spring 102 is positioned between insert 98 and bore shoulder 92 to bias insert 98 outwardly. Insert 98 is retained within bore 86 by shoulder 105 contacting roll pin 94 as shown in FIG. 7. A rectangular back plate 104 is attached to housing 18 adjacent outer wall 20 by a plurality of screws 106 (only one shown) traversing holes in plate 104 and seating within a like number of threaded bores in housing 18 in a common manner. A front plate 112 having an arcuate end 114 to accommodate curved proximal end 26 of housing 18 is attached to the housing by a plurality of screws 106 which traverse screw holes in the plate and are seated within threaded bores of the housing in a common manner. The upper end 115 of front plate 112 is curved in an opposite direction to that of arcuate end 114. Arcuate end 114 of plate 112 includes a notch 113 as illustrated in the figures.

Figure 3:
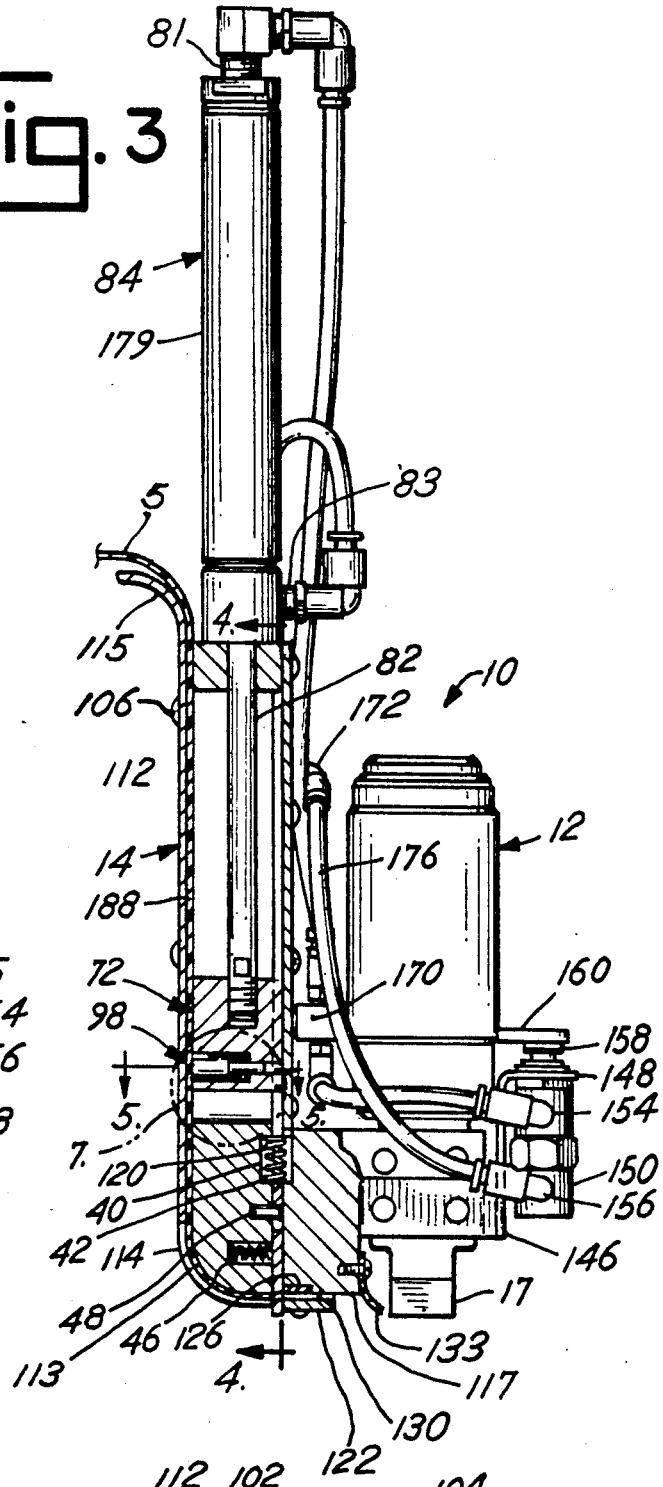
FIG. 3 is an elevational view of the invention with portions cut away for illustrative purposes.

Housing 18 is attached to stapling gun 12 through mounting block 118 with cutter 56 positioned therebetween. As illustrated, mounting block 118 has a cavity 120 similar to cavity 40 which is aligned with cavity 40 to house a portion of helical spring 42. A plate 112 has a notch 124 formed thereon and a spacer 126 is attached via fasteners 128 to the bottom wall 117 of block 118 and defines a channel 130 therebetween (se FIG. 3) to allow for passage of a label 5. A label guide 133, which has an arcuate end as illustrated, is attached to block 118 via screw 134 so as to have its curved end positioned in alignment with channel 130 adjacent stapler head 17. Block 118 is attached to the stapler body by screws 136 traversing bores 138 and seated in threaded bores 140 of the stapler body. Block 118 is attached to housing 18 by screws 142 with cutter 56 and lever 52 shiftably carried therebetween. A bracket 146 preferably shaped as illustrated in the figures is attached to block 118 by screws 148 and is included to support a pneumatic spool valve 150.

As common in the industry, spool valve 150 includes an air input port 152 and output ports 154 and 156 which are selectively placed in flow communication with the input port by an internal plunger (not shown) which has a shaft that extends outwardly as is common in the industry. Input port 152 is in flow communication with air line 19 as illustrated in FIG. 1. The actual internal workings of spool valve 150 are not illustrated as such construction is common in the industry and do not constitute a novel portion of this invention. Simply stated, output ports 154 and 156 are selectively connected to the input port upon shifting the plunger (not shown) by pressing downwardly on the plunger extension 158 and then releasing it.

A trigger extension 160 is connected to stapler trigger 162 and is provided to engage the plunger extension 158 of spool valve 150.

pneumatically driven power member 164 is attached to housing 18 through a bracket 166 in a common manner and includes a cylinder 165 which carries a piston rod 168 having a distal end which engages the exposed end 53 of lover 52. Power member 164 includes air ports 170 and 172 which are connected to valve output ports 154 and 156 respectively by air lines 176 in a manner common in the pneumatic art.

A second pneumatic power unit 84 is attached to the distal end 24 of housing 18 in a common manner by one end of cylinder 179 restrictively fitted in through bore 85. Power member 84 is longitudinally aligned with housing 18 and has its piston rod 82 extending through longitudinal through bore 85 and into channel 28. As mentioned previously, the threaded end of piston rod 82 is screwed into bore 80 of label advancing block 72. As illustrated in FIG. 1, power member 84 includes air ports 81, 83 which are connected by common air lines in flow communication with ports 170, 172, respectively of power member 164.

Label roll support 21 includes a fixed support plate 23 and a removable friction imparting plate 25. Plate 23 is attached to housing 18 via screws 174. Plate 25 is generally U-shaped and is connected to plate 23 by bolt 178 and spring 180 assembly illustrated in the figures. Spring 180 biases plate 25 toward plate 23.

Figure 2:
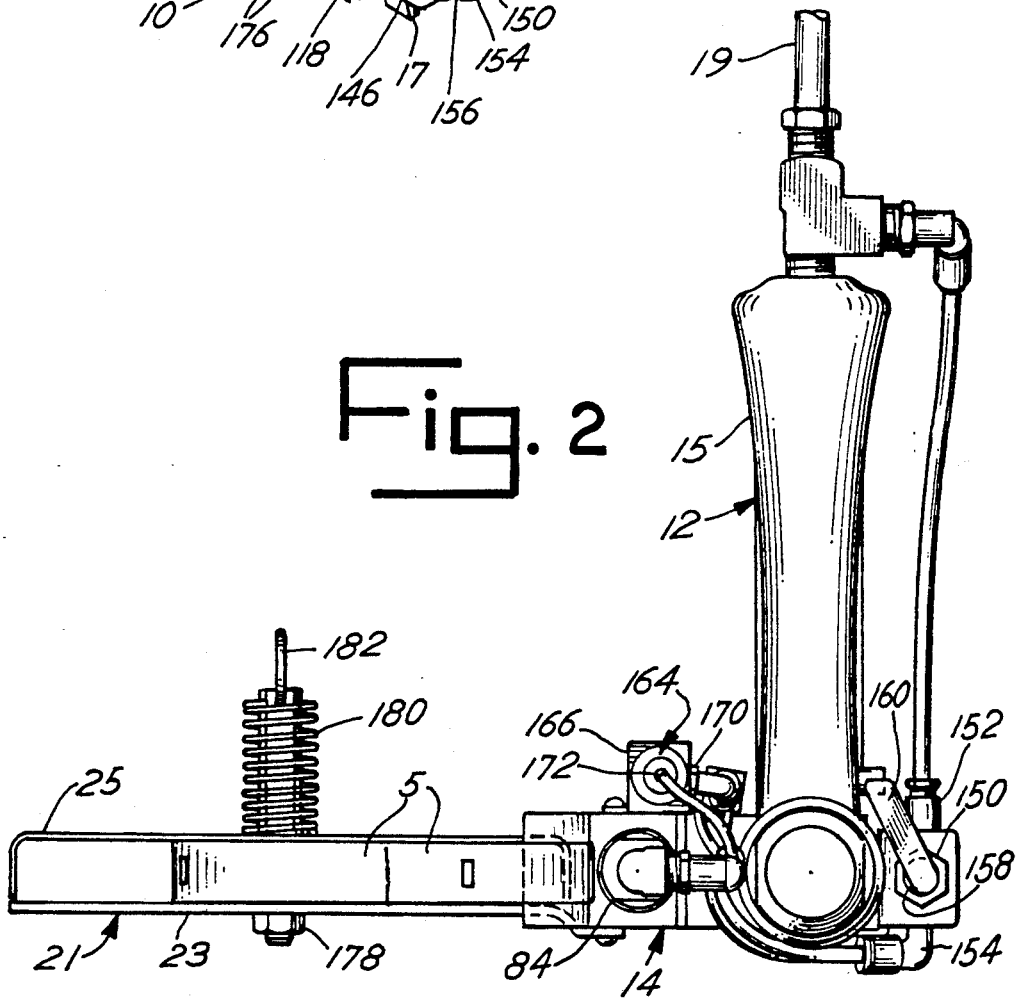
FIG. 2 is a top view of the invention of FIG. 1.
Figure 5:
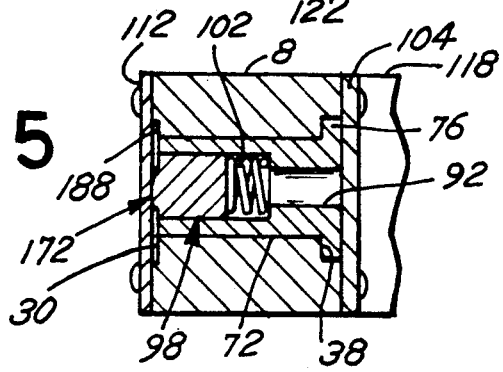
FIG. 5 is a fragmented cross sectional view taken along line 5—5 of FIG. 3.

In use, the staple gun 12 of label stapler 10 is connected to a suitable pressurized air source as is common in the industry by air line 19. Cotter pin 182 is removed from bolt 178 and plate 25 is slid off the bolt to position the roll of labels 5 therebetween as illustrated in FIGS. 1 and 2. Plate 25, spring 180 and pin 182 are then replaced and are included to provide friction against roll 5. The free end of the label roll 5 is inserted into label feeding attachement 14 by threading the free end of the roll between front plate 112 and groove 30 of housing 18. As illustrated best in FIG. 5, minimal clearance exists between front plate 112 and the surface formed by groove 30 which forms a label channel 118 therebetween. Channel 188 extends the length of housing 18 outer wall 20. When piston rod 168 of power member 164 is in its retracted position channel 188 is aligned with slot 54 of cutter 56. Channel 188 is further in alignment with channel 130 formed between spacer 126 and plate 122 mentioned previously.

Figure 4:
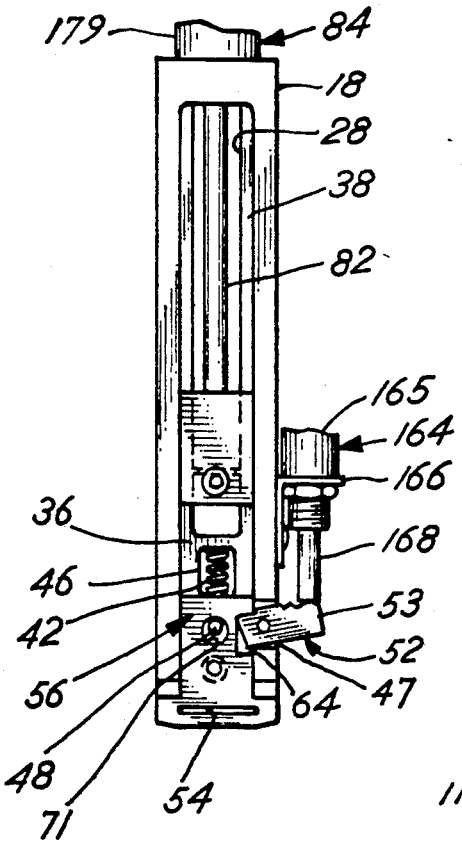
FIG. 4 is a fragmented sectional view taken along line 4—4 of FIG. 3.

Initially with a pressurized air supply connected to label stapler 10, spool valve 150 directs air from input 152 to output port 154 which places power member 164 in its retracted position of FIG. 4 and power member 84 in its fully extended position. The terms fully extended and retracted relative to the power members relate to the orientation of the piston rods 82, 168. With respect to the cylinder sleeve as is common in the industry.

When trigger 162 of staple gun 12 is squeezed toward handle 15 to eject a staple (not shown) from head 17, trigger extension 160 presses downwardly on shaft extension 158 of spool valve 150 which internally places input port 152 of the valve in flow communicaiton with output port 156 to thereby direct airflow to port 172 of power member 164 and port 83 of power member 84. Pressurized airflow directed in such a manner causes rod 168 to extend and rod 82 to retract. Label advance head 72 follows piston rod 82.

The extension of rod 168 presses downwardly on exposed end 53 of lever 52 to pivot the lever about pin 49. As illustrated in FIG. 4, the other end of lever 52 is seated within notch 64 of cutter 56. cutter 56 is slidably retained between block 118 and inner wall 22 of housing 18 and is biased downwardly by helical spring 42 contacting cutter upper wall 58 and is biased against block 118 by spring 46. When lever end 53 is pushed downwardly by rod 168, lever 52 is privoted about pin 49 to urge cutter 56 upwardly and shift slotted opening 54 out of alignment with groove 30.

When staple gun trigger 162 is released, trigger extension 160 is pivoted upwardly to release plunger extension 158 of spool valve 150 which reconnects input port 152 to output 154. This urges rods 168 and 82 into their initial positions. With rod 168 retracted, cutter 56 returns to its original position under force of spring 42.

As the advance head 72 is pushed downwardly toward proximal end 26 of body 18 protrusion 107 engages a notch 190 between two labels 5 to thereby push a label 5 through cutter slot 54 and channel 130 to be positioned adjacent stapler head 17 by guide 133. As label advancing head 72 is raised by rod 82 the label engaging insert 98 having the curved upper wall 101 cams inwardly to slide past the continuous string of labels 5 and notches 190. To prevent labels 5 from following the movement of label advance head 72, spring 34 is carried within notch 32 in communication with label channel 188. Notch 32 is longer than spring 34 to allow the spring to shift within the notch a small amount. As illustrated best in FIGS. 6 and 9, spring 34 includes a rounded back portion 35 and a generally flat extending front portion 33. As a continuous string of labels 5 is pulled downwardly by label advance head 72, spring front portion 33 lies within groove 34 substantially level with groove 30. However, while label advance head 72 with the label engaging insert 98 is pulled upwardly by power member 84 the continuous string of labels 5 attempts to follow advance head 72 upwardly. This slight upward progression of the labels urges spring 34 upwardly in the channel causing the spring front 33 to pivot outwardly from the channel about its curved back portion 35 to engage the labels 5 and frictionally restrain them from further upward progression.

With a label 5 extending through channel 130 and in alignment with staple head 17 as trigger 162 of staple gun 12 is squeezed toward its handle 14, the internal power member (not shown) of staple gun 12 drives the staple outwardly of head 17 into label 5 to affix the label to a wooden surface (not shown). Almost simultaneously with the staple being ejected from staple gun 12, power member 164 activates cutter 56 as previously described to sever the label 5 from the remainder of the roll and rod 82 retract. When the trigger is released, power member 164 deactivates cutter 56, and rod 82 extends to push downwardly on advance head 72 and advance the next label 5 through slot 54 of cutter 52 and into an alignment with staple head 17 for stapling. Therefore a label can be stapled, severed and the next label advanced into alignment as fast as the power members 84 and 164 can react which in a general state of the art under proper operating conditions is almost simultaneous with trigger activation.

It should be understood that this invention is not to be limited to the details above, but may be amended within the scope of the appended claims.

We claim:

1. a stapler comprising a staple gun means for driving a staple into an aligned label to affix said label to said support surface, a continuous sequence of labels positioned adjacent to said staple gun means, advancing means for selectively urging a single label of said continuous sequence of labels into alignment with said staple gun means wherein the single label is affixed to said support surface, and cutting means shiftably carried by said advancing means for severing said single label from said continuous sequence of labels after said staple has been driven into said label by said staple gun means, said staple gun means including a staple exit, said advancing means including a housing, said housing defining a channel constituting means for guiding said continuous sequence of labels into alignment with said staple exit, an elongated slot defined in said housing in communicaiton with said guiding means, and means for engaging said continuous sequence of labels shiftably carried within said elongated slot, said engaging means including a body slidably accommodated within said housing elongated slot, said body being shiftable between first and second positions, said first and second positions being defined by longitudinal extremities of said slot, an insert shiftably carried by said body to engage said continuous sequence of labels as said body shifts from its first position to its said second position, said insert being shifted away from said strip of labels when said body shifts from its second position to its first position.

2. The stapler of claim 1 and means carried by said housing for shifting said body between its first and second positions.

3. the stapler of claim 1 wherein said insert is biased toward said continuous sequence of labels and includes a protrusion, said continuous sequence of labels including openings formed between adjacent labels, said insert protrusion seating within one of said openings when said body is shifted from its first position to its second position.

4. the stapler of claim 2 wherein said shifting means includes a power member carried by said advancing means said power member including a piston rod connected at one end to the body of said engaging means, said piston rod being shifted between retracted and extended positions, said body being in its first position when said piston rod is in its said retracted position, said body being in its said second position when said piston rod is in its said extended position.

5. The stapler of claim 1 and a friction imparting member carried by said housing in communication with said guiding means and being pivotal between an engaged position and a non-engaged position with said continuous sequence of labels, said friction imparting member being shifted from its non-engaged position to its engaged position by said continuous sequence of labels when said body of said engaging means is shifted from its second position to its first position.

6. The stapler of claim 5 wherein said friction imparting member includes a shaft and angled back portion connected by a return bent part, said friction imparting member being accommodated within an elongated cavity in said housing, said cavity being in communication with said guiding means, said angled back portion contacting said housing with said shaft extending into said channel.

* * * * *

UNITED STATES PATENT AND TRADEMARK OFFICE

CERTIFICATE OF CORRECTION

PATENT NO. : 5,014,896

DATED : May 14, 1991

INVENTOR(S) : Reitmeier, et al.

It is certified that error appears in the above-identified patent and that said Letters Patent is hereby corrected as shown below:

Column 2, line 30, please delete "channel 28" and insert -- slot 28 -- therefor, to correspond with the terminology used throughout the specification.

Column 2, line 34, please delete "channel 28" and insert -- slot 28 -- therefor, to correspond with the terminology used throughout the specification.

Column 2, line 40, please delete "channel 28" and insert -- slot 28 -- therefor, to correspond with the terminology used throughout the specification.

Column 2, line 62, please delete "notch 28" and insert -- slot 28 -- therefor, to correspond with the terminology used throughout the specification.

Column 3, lines 13-14, please delete "roll pin 94" and and insert -- roll pin 96 -- therefor, to correspond with the drawings.

Column 3, line 32, please delete "plate 112" and insert -- plate 122 -- therefor, to correspond with the drawings.

olumn 3, line 64, please delete "pneumatically" and insert -- Pneumatically -- therefor.

UNITED STATES PATENT AND TRADEMARK OFFICE

CERTIFICATE OF CORRECTION

PATENT NO. : 5,014,896

DATED : May 14, 1991

INVENTOR(S) : Reitmeier, et al.

It is certified that error appears in the above-identified patent and that said Letters Patent is hereby corrected as shown below:

Column 3, line 68, please delete "lover 52" and insert -- lever 52 -- therefor, to correct spelling.

Column 4, line 9, please delete "channel 28" and insert -- slot 28 -- therefor, to correspond with the terminology used throughout the specification.

Column 4, line 11, please delete "block 72" and insert -- head 72 -- therefor, to correspond with the terminology used throughout the specification.

Column 4, line 35, please delete "channel 118" and insert -- channel 188 -- therefor, to correspond with the drawings.

Column 4, lines 52-53, please delete "shaft extension" and insert -- plunger extension -- therefor, to correspond with the terminology used throughout the specification.

Column 5, line 38, please delete "handle 14" and insert -- handle 15 -- therefor, to correspond with the drawings.

Column 5, line 48, please delete "cutter 52" and insert -- cutter 56 -- therefor, to correspond with the drawings.

UNITED STATES PATENT AND TRADEMARK OFFICE

CERTIFICATE OF CORRECTION

PATENT NO. :5,014,896

DATED :May 14, 1991

INVENTOR(S) :Reitmier, et al.

It is certified that error appears in the above-indentified patent and that said Letters Patent is hereby corrected as shown below:

Claim 1, column 5, lines 60-61, delete " said support surface" and insert --a support surface--.

Signed and Sealed this

Ninth Day of November, 1993

*Attest:*

*Attesting Officer*

BRUCE LEHMAN

*Commissioner of Patents and Trademarks*